US005645146A

United States Patent [19]

Bieber et al.

[11] Patent Number: 5,645,146

[45] Date of Patent: Jul. 8, 1997

[54] SUITCASE WITH RETRACTABLE PULL HANDLE

[75] Inventors: David Bieber, East Greenwich, R.I.; Hyun S. Kim, New Castle, Pa.; Richard L. Conrad, Dublin, Ohio; John N. Gualtieri, Hauppauge, N.Y.

[73] Assignee: Airway Industries, Inc., Ellwood City, Pa.

[21] Appl. No.: 335,584

[22] Filed: Nov. 8, 1994

[51] Int. Cl.[6] ..... A45C 5/14; A45C 13/22; A45C 13/26

[52] U.S. Cl. ..... 190/18 A; 190/39; 190/115; 190/127; 280/37; 280/655.1

[58] Field of Search ..... 190/18 A, 39, 190/115, 117, 127; 280/655, 655.1, 37, 47.29

[56] References Cited

U.S. PATENT DOCUMENTS

| | | | |
|---|---|---|---|
| 959,235 | 5/1910 | Lemieux | 190/115 X |
| 3,960,252 | 6/1976 | Cassimally | 190/18 A |
| 4,062,429 | 12/1977 | Tabor et al. | 190/18 A |
| 4,087,102 | 5/1978 | Sprague | 190/18 A X |
| 4,411,343 | 10/1983 | Cassimally et al. | 190/18 A |
| 4,538,709 | 9/1985 | Williams et al. | 190/18 A |
| 4,618,035 | 10/1986 | Mao | 280/37 X |
| 4,693,345 | 9/1987 | Mittelmann | 190/10 A X |
| 4,733,549 | 3/1988 | Baker | 190/115 X |
| 4,759,431 | 7/1988 | King et al. | 190/18 A |
| 4,792,025 | 12/1988 | Thomas | 190/18 A |
| 4,887,751 | 12/1989 | Lehman | 190/18 A X |
| 4,966,259 | 10/1990 | Bergman | 190/117 X |
| 4,995,487 | 2/1991 | Plath | 190/18 A |
| 5,048,649 | 9/1991 | Carpenter et al. | 190/18 A |
| 5,103,975 | 4/1992 | Liu | 190/115 X |
| 5,167,306 | 12/1992 | Carrigan, Jr. | 190/115 X |
| 5,197,579 | 3/1993 | Bieber et al. | 190/115 X |
| 5,240,106 | 8/1993 | Plath | 190/115 X |
| 5,295,565 | 3/1994 | Latshaw | 190/18 A |
| 5,323,887 | 6/1994 | Scicluna et al. | 190/115 X |
| 5,431,262 | 7/1995 | Rekuc et al. | 190/115 X |
| 5,431,263 | 7/1995 | Nordstrom | 190/18 A |

FOREIGN PATENT DOCUMENTS

| | | | |
|---|---|---|---|
| 2641172 | 7/1990 | France | 190/18 A |
| 2661807 | 11/1991 | France | 190/18 A |
| 9318684 | 9/1993 | WIPO | 190/115 |

*Primary Examiner*—Sue A. Weaver

*Attorney, Agent, or Firm*—Walter J. Blenko, Jr.; Kirk D. Houser; Eckert Seamans Cherin & Mellott, LLC

[57] ABSTRACT

A suitcase has a retractable pull handle. The suitcase includes parallel front and back panels and a wall member which combine to define an enclosed volume. A rigid pull handle is mounted in juxtaposition to the top portion of the wall member. Rollers are mounted on the bottom portion of the wall member opposite the pull handle. The pull handle is extendable to pulling position extending generally parallel to the front and back panels. In the extended position, the pull handle is operable to enable a user to roll the suitcase across a surface on the rollers with the weight of the suitcase being distributed between the rollers and the pull handle. The pull handle is retractable into the inside of the suitcase when not in use. In the retracted position, the gripping member of the pull handle is received into a handle receptacle recessed into the top portion of the wall member. A closure secures the pull handle inside the handle receptacle to prevent accidental extension of the pull handle.

18 Claims, 5 Drawing Sheets

SUITCASE WITH RETRACTABLE PULL HANDLE

BACKGROUND OF THE INVENTION

1. Field of the Invention

This invention relates to a suitcase equipped for rolling motion over a surface, and, more particularly, to a suitcase having a retractable pull handle.

2. Background Information

Suitcases are available in a wide variety of shapes and sizes. Traditionally, suitcases have been provided with a single carrying handle to allow the user to lift the suitcase and carry it from place to place. In order to ease the load that a traveller must bear as he manually moves his suitcase from place to place, it is desirable to provide rollers on the bottom of the case. Rollers permit the suitcase to be rolled across a surface, such as a floor. It is also desirable to have some type of handle secured to the case to permit the user to steer the rolling suitcase.

Some such suitcases have handles, or straps, which permit the entire weight of the case to be carried by the rollers. Other types have handles that require the user to lift up, or tilt down, the suitcase so that a portion of the suitcase's weight is carried by the handle.

When a rigid handle is provided, it is desirable for the handle to be movable between a storage position and an operable position. In that way, the handle can be stored when not in use and will be less susceptible to damage when the suitcase is moved through luggage handling systems in airports and the like. However, without means for locking the handle into the storage position, it could accidentally deploy and be damaged during transit.

SUMMARY OF THE INVENTION

This invention provides a suitcase having a rigid, retractable and extendable pull handle which does not extend substantially beyond the exterior surface of the suitcase when the pull handle is retracted and which may be secured into the retracted position, and a pair of parallel, spaced apart panels. These panels are connected about their peripheries by a wall member. The panels and wall member cooperate to define a volume. The wall member has a top portion and a bottom portion positioned opposite one another. At least a portion of the wall member is rigid to provide support therefor.

Rollers are mounted in juxtaposition to the bottom portion of the wall member. The rollers are positioned to at least partially support the suitcase when it is upright. The rollers also cooperate with a pull handle to enable rolling movement of the suitcase across a surface.

The rigid pull handle is mounted in juxtaposition to the top portion of the wall member. The handle is alternately retractable into the volume and extensible to a position in which it extends outwardly from the top portion of the wall member and generally parallel to the panels. When the handle is in the extended position, it is operable to enable rolling movement of the suitcase on the rollers with the suitcase's weight being distributed between the rollers and the handle. The handle retracts and extends on a carrier mounted inside the case.

A handle receptacle is mounted on the top rigid portion of the wall member and recessed into the volume. The handle receptacle is positioned to receive the handle when the handle is retracted. The receptacle includes a curved guide portion for guiding the user's fingers around the handle for gripping. A closure over the receptacle is provided for securing the handle inside the receptacle so that the handle is inside the volume when in the retracted position.

DESCRIPTION OF THE PREFERRED EMBODIMENT

Figure 1:
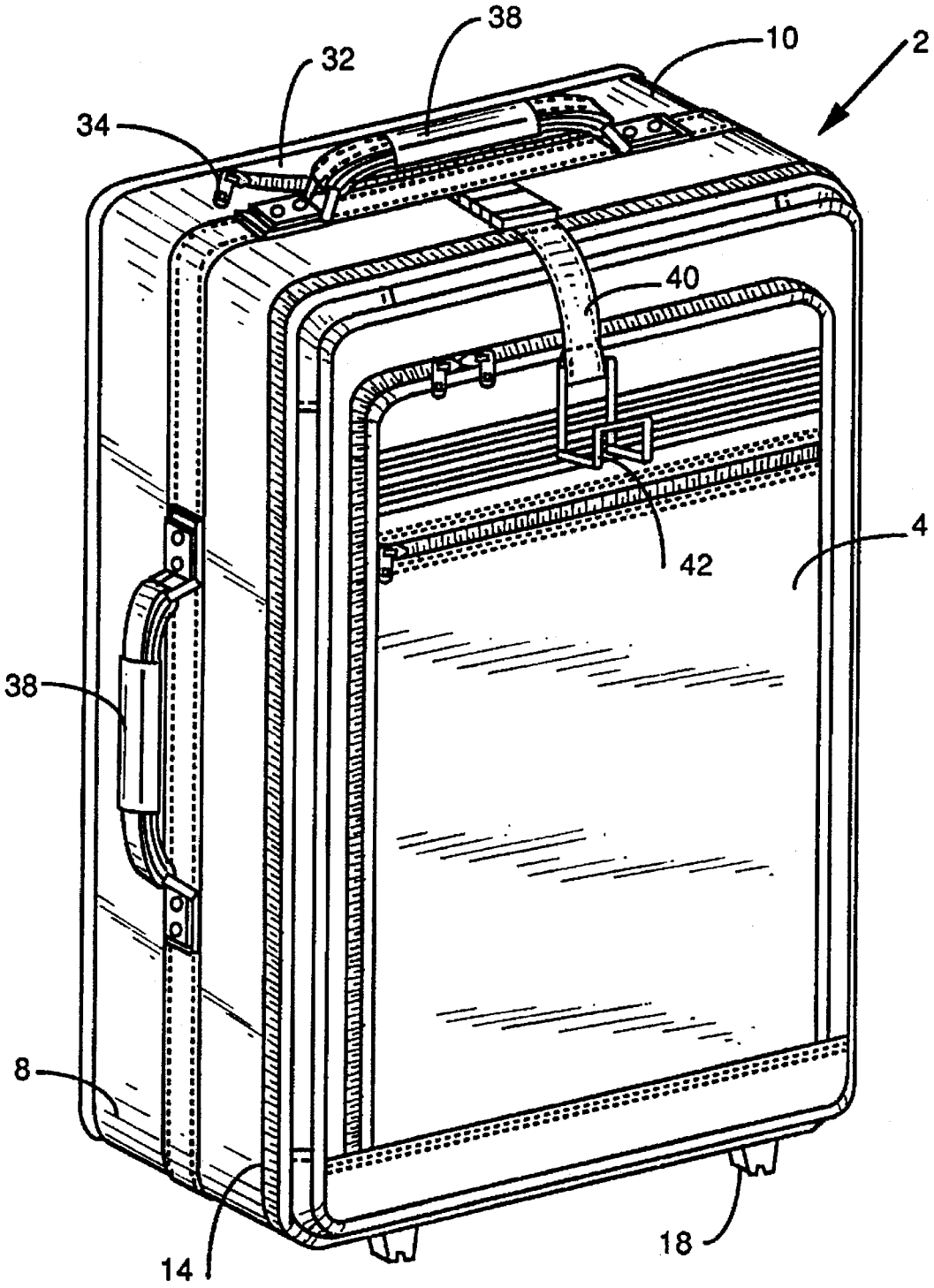
FIG. 1 is a front perspective view of the suitcase embodying my invention with the handle retracted.
Figure 2:
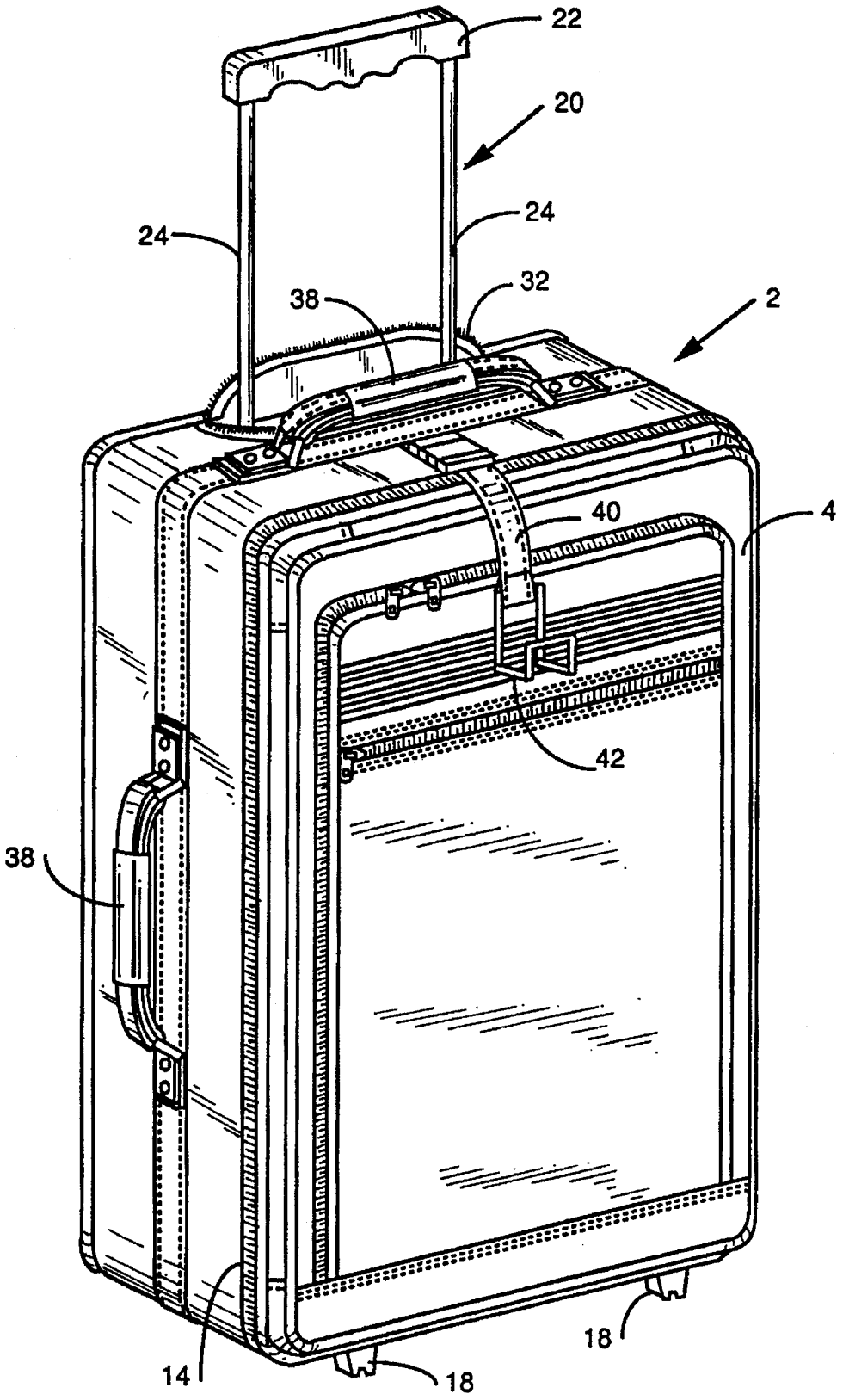
FIG. 2 is a front perspective view of the suitcase of FIG. 1 with the handle extended.

FIGS. 1–4 show a presently preferred embodiment of a suitcase 2 embodying the invention. Suitcase 2 includes generally parallel front and back panels 4 and 6 which are spaced apart. The peripheries of panels 4 and 6 are connected to wall member 8. Wall member 8 includes a top portion 10 and a bottom portion 12. At least a portion of wall member 8 is generally rigid to provide structural support for wall member 8 and to maintain the shape of the suitcase 2. In a preferred embodiment, top portion 10 and bottom portion 12 of wall member 8 are rigid. In addition, wall member 8 is preferably provided with a rigid spine extending around a central portion thereof.

Panels 4 and 6 and wall member 8 cooperate to define a volume inside suitcase 2. A glide fastener 14 is preferably provided around the periphery of front panel 4 to provide access to the inside of suitcase 2.

In a preferred embodiment, panels 4 and 6 and wall member 8 are made of soft fabric, such as ballistic nylon or canvas. However, any suitable material may be used. The rigidity of wall member 8 is provided by attaching it to rigid thermoplastic panels and to the thermoplastic spine.

Rollers 16 are mounted at the junction of bottom portion 12 of wall member 8 and back panel 6. Rollers 16 extend downwardly from bottom portion 12 and support at least a portion of the weight of suitcase 2 when it is in the upright position. Legs 18 are mounted on bottom portion 12 of wall member 8. Legs 18 also support a portion of the weight of suitcase 2 when it is upright and enables the suitcase to stand upright without other external support.

Figure 4:
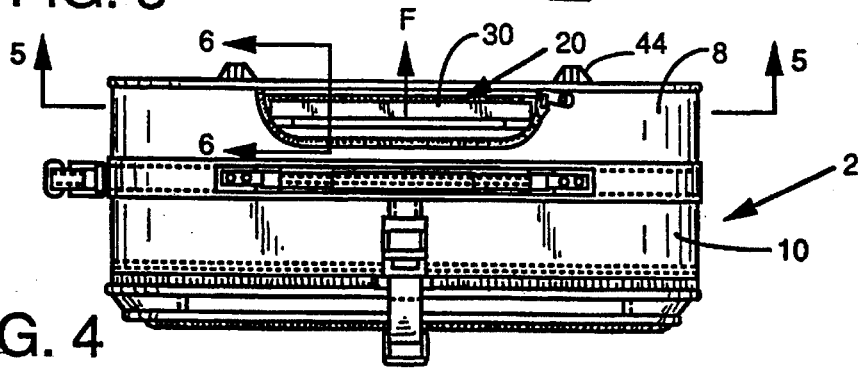
FIG. 4 is a plan view of the suitcase of FIG. 1 with the handle extended.
Figure 7:
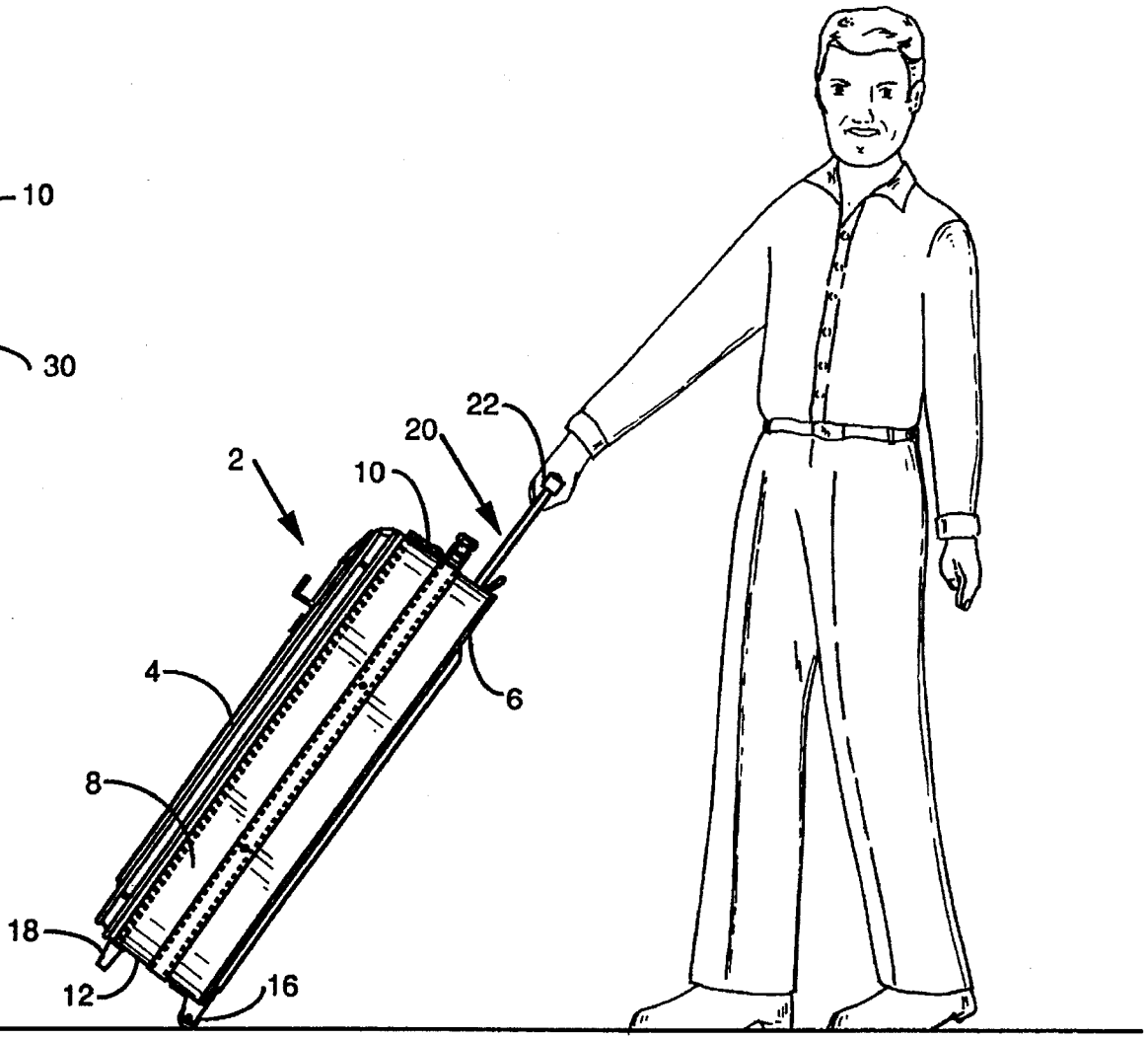
FIG. 7 is a side view of the suitcase of FIG. 1 when in use.

A rigid pull handle 20 is mounted on top portion 10 of wall member 8. Pull handle 20 is alternately retractable into suitcase 2 and extendable therefrom. Pull handle 20 includes a gripping member 22 and two generally parallel legs 24. Pull handle 20 extends outwardly from top portion 10 of wall member 8 and generally parallel to panels 4 and 6 when it is extended. When extended, pull handle 20 is operable to permit the suitcase to be rolled across a surface on rollers 16 with the weight of the suitcase distributed between pull handle 20 and rollers 16, as shown in FIG. 7. The majority of the weight of suitcase 2 is carried by rollers 16. The user grips gripping member 22 of the extended pull handle 20 and applies force F in the direction shown (FIG. 4). The moment created by the force rotates the suitcase about the axis of rotation of rollers 16. The user can then support a portion of the weight of suitcase 2 by holding pull handle 20 as shown in FIG. 7. The remainder of the weight of the suitcase 2 is supported by rollers 16. As the user walks, the suitcase 2 is pulled and rolls along behind the user. The user can then use pull handle 20 to steer the suitcase 2 as it is being pulled with virtually the entire weight carried by rollers 16. The user must apply only small amounts of lifting force to pull handle 20 to keep the suitcase 2 balanced on rollers 16. Likewise, only a small amount of steering force must be applied to steer the suitcase. The process may be reversed to return the suitcase to the upright position.

Figure 5:
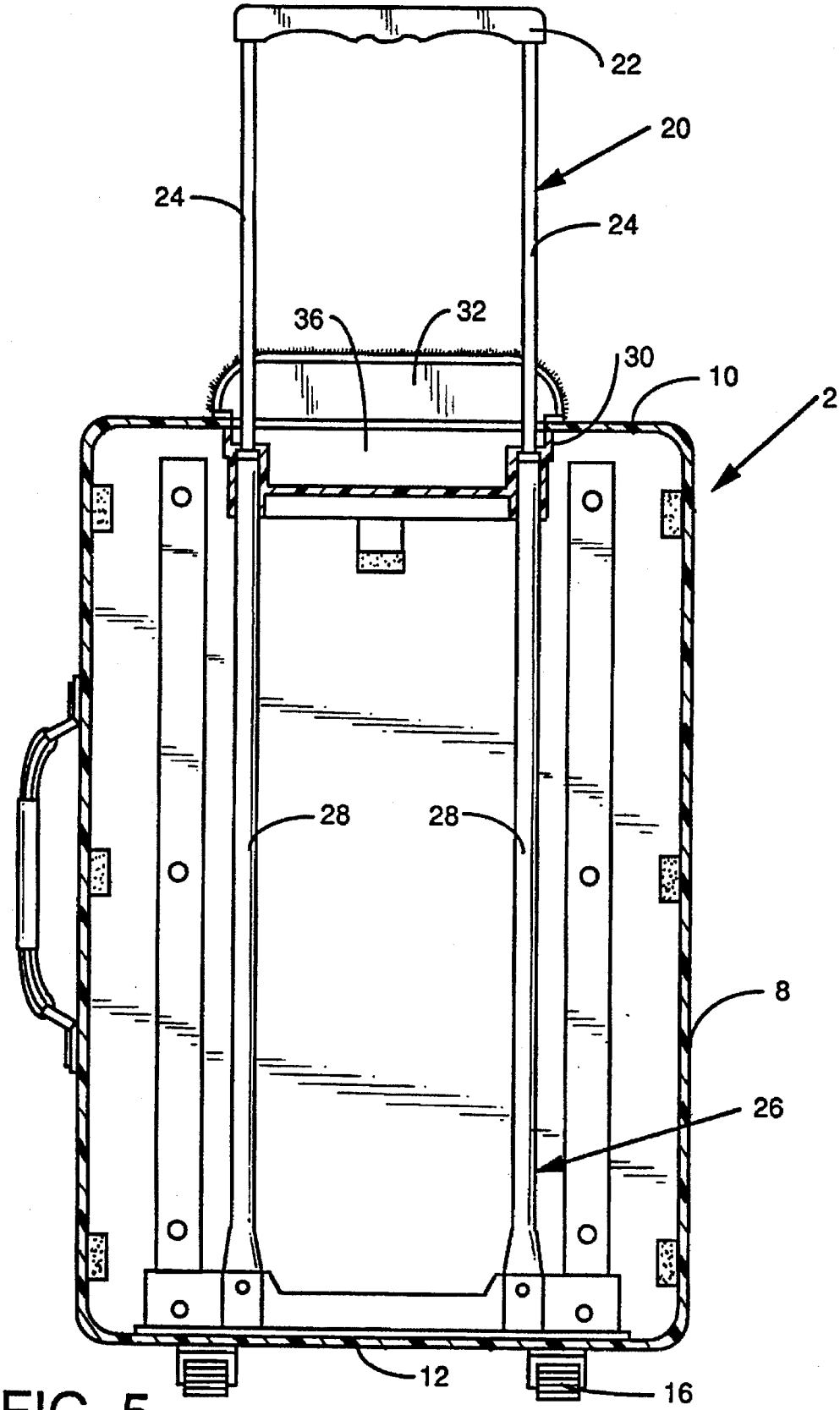
FIG. 5 is a longitudinal sectional view taken through line 5—5 of FIG. 4.

Referring to FIG. 5, one end of each leg 24 of pull handle 20 is movably mounted to carrier 26, located inside the suitcase. Carrier 26 includes two generally parallel tube members 28 extending between the inside of top portion 10 and bottom portion 12 of wall member 8 and generally parallel to panels 4 and 6. Tube members 28 are mounted to the rigid portion of those areas of wall member 8. A covering has been provided extending over carrier 26 to permit contact between carrier 26 and items placed inside suitcase 2. In the preferred embodiment, legs 24 of pull handle 20 telescope inside tube member 28. Locking means such as a spring biased detent may be provided to lock pull handle 20 in the extended position.

Pull handle 20 and carrier 26 are positioned immediately adjacent to back panel 6 and directly above rollers 16. It has been found that such a position maximizes ease of use and maximizes usable storage space inside the suitcase.

Figure 6:
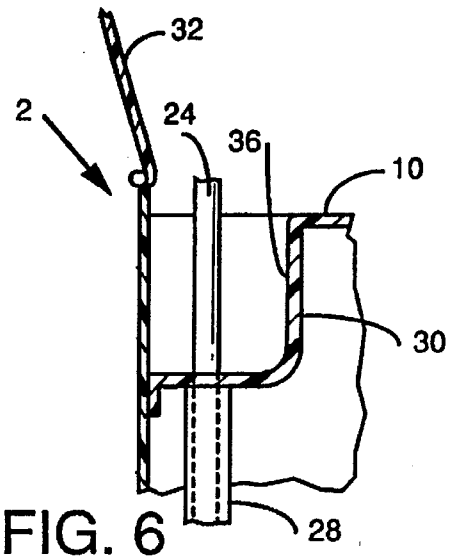
FIG. 6 is a partial sectional view taken through line 6—6 of FIG. 4.

Handle receptacle 30 is mounted on top portion 10 of wall member 8. Handle receptacle 30 is preferably recessed into the inside of the suitcase, as is best shown in FIGS. 5 and 6. Legs 24 of pull handle 20 extend through handle receptacle 30 and tubes members 28 of carrier 26 are secured to handle receptacle 30. Handle receptacle 30 is structured to receive gripping member 22 of pull handle 20 therein when pull handle 20 is in the retracted position. It will be appreciated that when gripping member 22 is received into handle receptacle 30, it does not protrude significantly above the exterior surface of top portion 10 of wall member 8. A closure 32 made of fabric having a glide fastener 34 is provided for securing gripping member 22 inside handle receptacle 30 when pull handle 20 is retracted. Securing closure 32 in place prevents accidental extension of pull handle 20. In this embodiment, closure 32 completely encloses handle receptacle 30 when pull handle 20 is in the retraced position.

As shown in FIG. 6, handle receptacle 30 is provided with a curved surface 36, or guide portion. Curved surface 36 extends from adjacent to top portion 10 of wall member 8 to a position under the location where gripping member 22 is positioned when pull handle 20 is retracted. Curved surface 36 provides a smooth guide for directing a user's fingers around gripping member 22 of pull handle 20 when in the retracted position.

Referring again to FIGS. 1 and 2, suitcase 2 is provided with at least one carrying handle 38 secured to a rigid portion of wall member 8. One carrying handle 38 is mounted on top portion 10 of wall member 8. A second carrying handle 38 is mounted on an adjacent side of wall member 8. The two carrying handles 38 provide versatility by enabling the user to carry the suitcase in different orientations.

Suitcase 2 is also provided with a piggyback strap 40 removably secured to a rigid portion of top portion 10 of wall member 8. Piggyback strap 40 includes a hook 42 structured to engage the carrying handle of another piece of luggage. Piggyback strap 40 thereby permits the second piece of luggage to be carried in a piggyback manner on suitcase 2. A quick release buckle of a type known to those skilled in the art is preferably used to removably attach piggyback strap 40 to suitcase 2.

Figure 3:
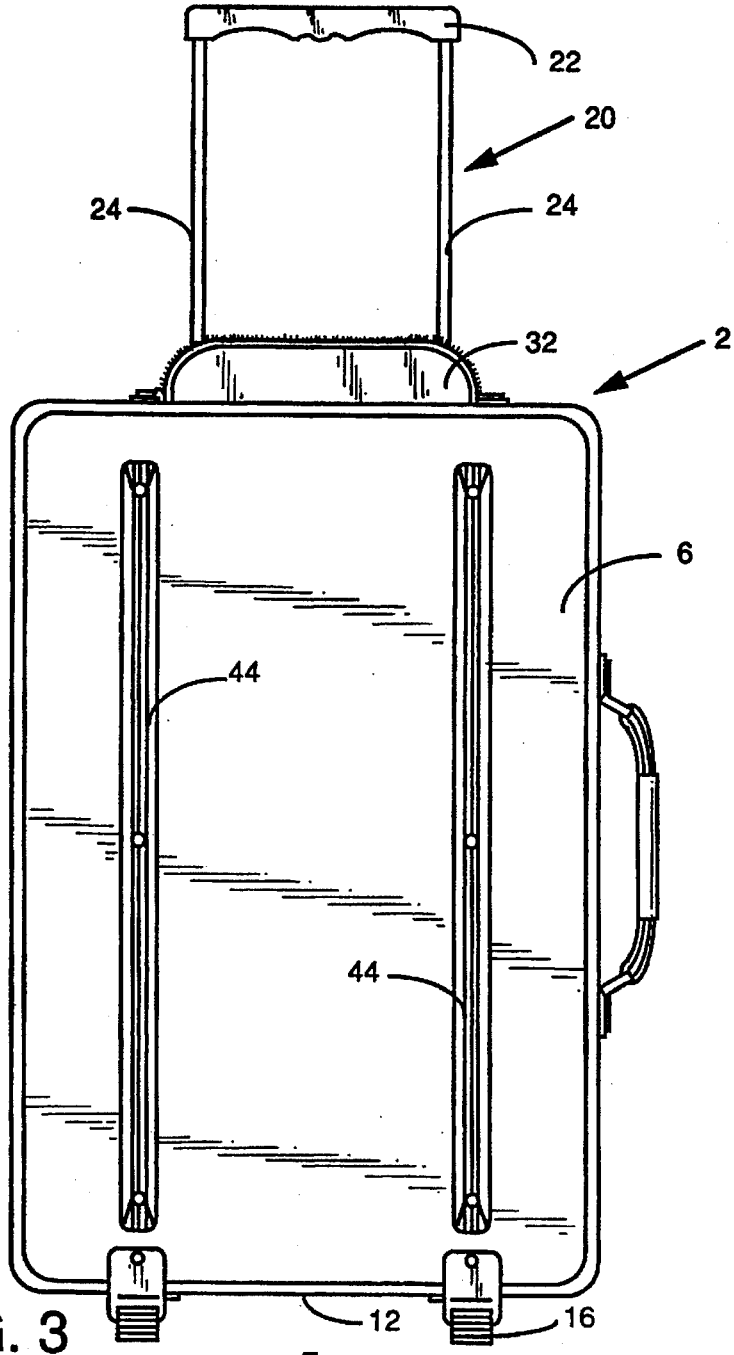
FIG. 3 is a rear elevational view of the suitcase of FIG. 1 with the handle retracted.

Referring to FIG. 3, a pair of skid bars 44 are secured to pack panel 6 of suitcase 2. Skid bars 44 extend generally parallel to pull handle 20 and are positioned between top portion 10 and bottom portion 12 of wall member 8. In a preferred embodiment, the longitudinal axis of skid bars 44 are aligned with rollers 16. Skid bars 44 are made of rigid thermoplastic. Skid bars 44 may be used to assist in sliding suitcase 2 vertically from one level to another, such as up stairs or from the floor on to a bed. Skid bars 44 present a smaller surface to the edge of the step than does panel 6 and also have a lower coefficient of friction than does the fabric from which back panel 6 is preferably made. Accordingly, there is less resistance to sliding movement when skid bars 44 are used.

Whereas particular embodiments of this invention have been described for purposes of illustration, it will be evident to those skilled in the art that numerous variations of the details may be made without departing from the invention as described in the appended claims.

What is claimed is:

1. A suitcase comprising:

generally parallel spaced apart front and back panels connected about their peripheries to a wall member, said wall member extending between said front and back panels, thereby defining a volume;

said wall member having a top portion and a bottom portion positioned opposite one another with at least a portion of said wall member being rigid;

roller means mounted in juxtaposition to said bottom portion of said wall member adjacent the periphery of the wall member and one of said front and back panels to at least partially support said suitcase when in an upright position and for enabling rolling movement of the suitcase across a surface;

a rigid telescoping pull handle having a gripping member thereon, said pull handle mounted in juxtaposition to said top portion of said wall member and extending generally outwardly from the top portion of said wall member and generally parallel to said panels, said pull handle being movably mounted to carrier means positioned within said volume and alternately retractable into said volume and extensible therefrom; the pull handle being operable when extended to enable rolling movement of the suitcase across a surface on said roller means with the weight of said suitcase being divided between said pull handle and said roller means;

a handle receptacle mounted on said wall member, said handle receptacle having a portion recessed inside said volume and positioned to receive said gripping member of said pull handle when said pull handle is retracted, said pull handle being movable in a telescoping motion between a retracted position in which said gripping member is inside said recessed portion of said handle receptacle and an extended position in which said gripping member is extended outside of said handle receptacle to permit the rolling movement of the suitcase by a user; and closure means for securing said gripping member inside said recessed portion of said handle receptacle when the pull handle is retracted and enclosed inside said volume, thereby securing said pull handle from accidental extension from said portion recessed inside said volume.

2. The suitcase of claim 1, wherein at least one carry handle is mounted on said rigid portion of said wall member outside said portion of said handle receptacle recessed inside said volume to permit carrying of the suitcase with its weight fully supported by said carry handle.

3. The suitcase of claim 1, wherein said rigid pull handle includes an extendable portion, said carrier means being mounted to at least one location on said rigid portion of said wall member inside said volume and extending generally parallel to said panels, said extendable portion being movably mounted on said carrier means for extension and retraction.

4. The suitcase of claim 3, wherein said front and back panels are soft and the periphery of said front panel includes a glide fastener for opening and closing said suitcase to permit access to said volume.

5. The suitcase of claim 4, wherein each of said top portion and bottom portion of said wall member includes a rigid portion; and said roller means are secured to the bottom rigid portion and the handle receptacle and at least one carry handle are secured to the top rigid portion.

6. The suitcase of claim 5, wherein said roller means includes a pair of rollers mounted on said bottom rigid portion of said wall member and positioned at the junction of said back panel and said wall member.

7. The suitcase of claim 1, wherein said handle receptacle includes a curved guide portion for guiding the user's fingers to engagement of said gripping member when said pull handle is retracted.

8. The suitcase of claim 3, wherein said extendable portion of said pull handle includes two generally parallel legs connected at one end by said gripping member; and said carrier means includes two generally parallel tube members connected to said top and bottom portions of said wall member, each of said tube members being structured to slidably receive one of said legs of said extendable portion of said pull handle.

9. The suitcase of claim 8, wherein said closure means includes a glide closure for providing access to said handle receptacle.

10. The suitcase of claim 6, wherein a hook member is secured to the top rigid portion of said wall member and positioned to engage a second piece of luggage.

11. The suitcase of claim 10, wherein a piggyback strap is removably secured to said top rigid portion of said wall member by connector means positioned on the external top portion of said wall member, said piggyback strap being structured to engage a handle of another piece of luggage whereby the other piece of luggage may be carried in a piggyback manner on the suitcase.

12. The suitcase of claim 1, wherein at least one skid bar is mounted on said back panel to aid in sliding said suitcase generally vertically along a generally vertical surface.

13. The suitcase of claim 12 wherein each skid bar extends substantially the full height of the suitcase.

14. The suitcase of claim 1, wherein said handle receptacle includes a curved surface extending from adjacent said top portion of said wall member to a position under a location where said gripping member is positioned when said pull handle is retracted.

15. The suitcase of claim 14, wherein said curved surface is a guide surface for guiding the user's fingers to engage said gripping member when said pull handle is retracted.

16. A suitcase comprising:

generally parallel spaced apart front and back panels connected about their peripheries to a wall member, said wall member extending between said front and back panels, thereby defining a volume;

said wall member having a top portion and a bottom portion positioned opposite one another with at least a portion of said wall member being rigid;

roller means mounted in juxtaposition to said bottom portion of said wall member adjacent the periphery of the wall member and one of said front and back panels to at least partially support said suitcase when in an upright position and for enabling rolling movement of the suitcase across a surface;

a handle receptacle mounted on said wall member, said handle receptacle having a portion recessed inside said volume;

a rigid telescoping pull handle having a gripping member thereon, said pull handle mounted in juxtaposition to said top portion of said wall member and extending generally outwardly from the top portion of said wall member and generally parallel to said panels, said pull handle being movably mounted to carrier means positioned within said volume and alternately retractable into said volume and extensible therefrom; said recessed portion of said handle receptacle positioned to receive said gripping member of said pull handle and a user's fingers around said gripping member when said pull handle is retracted; said pull handle being movable in a telescoping motion between a retracted position in which said gripping member is inside said recessed portion of said handle receptacle and an extended position in which said gripping member is extended outside of said handle receptacle to permit the rolling movement of the suitcase by the user; said pull handle being operable when extended to enable rolling movement of the suitcase across a surface on said roller means with the weight of said suitcase being divided between said pull handle and said roller means; and closure means for securing said gripping member inside said recessed portion of said handle receptacle when said pull handle is retracted and enclosed inside said volume, thereby securing said pull handle from accidental extension from said portion recessed inside said volume, said closure means including enclosing means for optionally enclosing said gripping member inside said recessed portion of said handle receptacle, and fastener means for optionally joining said enclosing means and a portion of said wall member and forming a generally smooth profile therebetween when said pull handle is secured.

17. The suitcase of claim 16, wherein said handle receptacle includes a curved surface extending from adjacent said top portion of said wall member to a position under a location where said gripping member is positioned when said pull handle is retracted.

18. The suitcase of claim 17, wherein said curved surface is a guide surface for guiding the user's fingers to engage said gripping member when said pull handle is retracted.

* * * * *

UNITED STATES PATENT AND TRADEMARK OFFICE

CERTIFICATE OF CORRECTION

PATENT NO. : 5,645,146
DATED : July 8, 1997
INVENTOR(S) : David Bieber et al.

It is certified that error appears in the above-indentified patent and that said Letters Patent is hereby corrected as shown below:

Column 3, line 40, "wail" should be — wall —.

Column 3, line 59, "wail" should be — wall —.

Column 3, line 60, "wail" should be — wall —.

Claim 7, column 5, line 35, "engagement of" should be — engage —.

Claim 16, column 6, line 20, "wail" should be — wall —.

Signed and Sealed this

Third Day of February, 1998

*Attest:*

Bruce Lehman

BRUCE LEHMAN

*Attesting Officer*

*Commissioner of Patents and Trademarks*